US011548777B2

(12) United States Patent
Guenthal et al.

(10) Patent No.: US 11,548,777 B2
(45) Date of Patent: Jan. 10, 2023

(54) YOKE COMPRISING CONTRACTING TIPS AND METHOD TO FACILITATE COMMUNICATION BETWEEN HORSE AND RIDER

(71) Applicant: LAUGHING HORSE INNOVATIONS, LLC, Ocala, FL (US)

(72) Inventors: Marcus Guenthal, Morriston, FL (US); Alejandro Francisco Valdivia Zuniga, Loxahatchee, FL (US)

(73) Assignee: LAUGHING HORSE INNOVATIONS, LLC, Ocala, FL (US)

( * ) Notice: Subject to any disclaimer, the term of this patent is extended or adjusted under 35 U.S.C. 154(b) by 79 days.

(21) Appl. No.: 17/166,415

(22) Filed: Feb. 3, 2021

(65) Prior Publication Data

US 2021/0238025 A1 Aug. 5, 2021

Related U.S. Application Data

(60) Provisional application No. 62/969,391, filed on Feb. 3, 2020.

(51) Int. Cl.

| | |
|---|---|
| ***B68B 1/00*** | (2006.01) |
| ***B68B 3/04*** | (2006.01) |
| ***B68B 3/08*** | (2006.01) |
| ***B68B 3/14*** | (2006.01) |

(52) U.S. Cl.

CPC ..... *B68B 1/00* (2013.01); *B68B 3/04* (2013.01); *B68B 3/08* (2013.01); *B68B 3/14* (2013.01)

(58) Field of Classification Search

CPC .... B68B 3/04; B68B 3/02; B68B 3/08; B68B 3/14; B68B 5/06; B68B 2001/006; B68B 1/00; B68B 1/04

See application file for complete search history.

(56) References Cited

U.S. PATENT DOCUMENTS 82,836 A * 10/1868 Lampman ..... B68B 3/04 54/21
157,367 A * 12/1874 Bright ..... B68B 3/04 54/18.1

(Continued)

OTHER PUBLICATIONS

PCT/US2021/035339, PCT search report & written opinion, dated Oct. 6, 2021, 8 pages.

*Primary Examiner* — Jessica B Wong
(74) *Attorney, Agent, or Firm* — Timothy H. Van Dyke; Wolter, Van Dyke, Davis, PLLC

(57) ABSTRACT

An apparatus and method are provided to facilitate horse riding. The apparatus includes a line that defines an opening sized to receive a head of the horse. The apparatus also includes one or more tips operatively connected to the line and oriented inward from the line into the opening. Upon positioning the head of the horse through the opening the one or more tips are positioned to engage a body of the horse. The method includes providing the apparatus and passing, the opening defined by the line, over the head of the horse. The method also includes passing, the rein, through openings defined by rings that are operatively connected to the line. The method also includes actuating the line to engage the horse to facilitate movement of the horse.

18 Claims, 16 Drawing Sheets

(56) References Cited

U.S. PATENT DOCUMENTS 284,563 A * 9/1883 Kinnier ..... B68B 1/04 54/36
323,735 A * 8/1885 Rice ..... B68B 3/04 54/67
383,143 A * 5/1888 Noyes ..... B68B 3/04 54/67
478,452 A * 7/1892 Mueller ..... B68B 3/04 54/21
773,015 A 10/1904 Kenny
987,127 A * 3/1911 Frigerb ..... B68B 3/04 54/67
1,016,048 A * 1/1912 Tiffany ..... B68B 3/04 54/20
1,017,188 A * 2/1912 Tix ..... B68B 3/04 54/29
1,073,657 A * 9/1913 Baughman ..... B68B 3/04 54/18.3
1,249,963 A * 12/1917 Howell ..... B68B 3/04 54/67
1,270,588 A * 6/1918 Barger ..... B68B 3/04 54/18.1
1,292,109 A * 1/1919 Siegenthaler ..... B68B 3/04 54/29
1,487,555 A * 3/1924 Germundson ..... B68B 3/04 54/19.3
1,514,558 A * 11/1924 Mogensen ..... B68B 3/04 54/67
1,574,478 A * 2/1926 Grings ..... B68B 3/04 54/19.1
1,776,849 A * 9/1930 Bott ..... B68B 3/04 54/19.1
2,466,213 A * 4/1949 Davis ..... B68B 3/04 54/21
3,306,005 A 2/1967 Stafford
3,319,605 A * 5/1967 Early ..... A01K 15/02 119/908
4,337,610 A 7/1982 Taylor
5,114,600 A 5/1992 Biggin et al.
5,660,031 A 8/1997 Clark
6,761,019 B2 7/2004 Earnhart

* cited by examiner

YOKE COMPRISING CONTRACTING TIPS AND METHOD TO FACILITATE COMMUNICATION BETWEEN HORSE AND RIDER

CROSS-REFERENCE TO RELATED APPLICATIONS

This application claims benefit of Provisional Application No. 62/969,391590, filed Feb. 3, 2020, the entire contents of which are hereby incorporated by reference as if fully set forth herein, under 35 U.S.C. § 119(e).

BACKGROUND

FIG. 1A is an image that illustrates an example of different regions of a body of a horse. FIG. 1B is an image that illustrates an example of a conventional system 100 to facilitate communication between a horse and a rider. The system 100 includes a bridle 104 that is secured around the head of the horse, a bit 106 connected to the bridle 104 and secured within a mouth of the horse and a rein 102 that is secured to the bit 106 and is held by the rider. The rider pulls on one or both of the left or right reins 102 in order to communicate with the horse.

SUMMARY

The inventors of the present invention recognized that conventional systems for communication between horses and riders are deficient. Specifically, the inventors realized that although the rider can communicate with the horse using the rein 102 (e.g. pull the left rein 102 to communicate a left turn to the horse, pull the right rein 102 to communicate a right turn to the horse, pull both the left and right reins to communicate braking to the horse and/or releasing the pressure and providing support with the leg will communicate acceleration to the horse), this communication is limited since the system only engages the head of the horse. Additionally, the inventors noticed that in some scenarios (e.g. where the horse is excited and the rider desires to calm the horse down) pulling on the reins 102 can have the opposite effect that the rider intends to communicate (e.g. pulling on the reins 102 can create further tension in the horse and thus fail to diffuse the horses excitement). Thus, to overcome these drawbacks the inventors of the present invention developed the apparatus and method discussed herein, which engages multiple regions of the body of the horse (e.g. head, shoulder, breast, etc.) in order to facilitate further communication between the horse and the rider.

In a first set of embodiments, an apparatus is provided to facilitate riding a horse with a rein. The apparatus includes a line that defines an opening sized to receive a head of the horse. The apparatus also includes one or more tips operatively connected to the line and oriented inward from the line into the opening such that upon positioning the head of the horse through the opening the one or more tips are positioned to engage a body of the horse.

In a second set of embodiments, a method is provided for facilitating riding a horse with a rein. The method includes providing an apparatus including a line having a first end and a second end, and a center piece operatively connected to the first end and the second end of the line so that the line defines an opening. The apparatus also includes a pair of middle tips operatively connected to the line and oriented inward from the line into the opening and a pair of rings operatively connected to the line that define second openings sized to receive the rein. The method also includes passing, the opening defined by the line, over a head of the horse so that the line encloses a neck of the horse, the center piece is adjacent a breast of the horse and the pair of middle tips are adjacent left and right points of shoulder of the horse. The method also includes passing, the rein, through openings defined by the pair of rings. The method also including actuating the line to engage one of the breast, left point of shoulder and right point of shoulder of the horse to facilitate movement of the horse.

Still other aspects, features, and advantages are readily apparent from the following detailed description, simply by illustrating a number of particular embodiments and implementations, including the best mode contemplated for carrying out the invention. Other embodiments are also capable of other and different features and advantages, and its several details can be modified in various obvious respects, all without departing from the spirit and scope of the invention. Accordingly, the drawings and description are to be regarded as illustrative in nature, and not as restrictive.

BRIEF DESCRIPTION OF THE DRAWINGS

Embodiments are illustrated by way of example, and not by way of limitation, in the figures of the accompanying drawings in which like reference numerals refer to similar elements and in which.

DETAILED DESCRIPTION

Figure 1A:
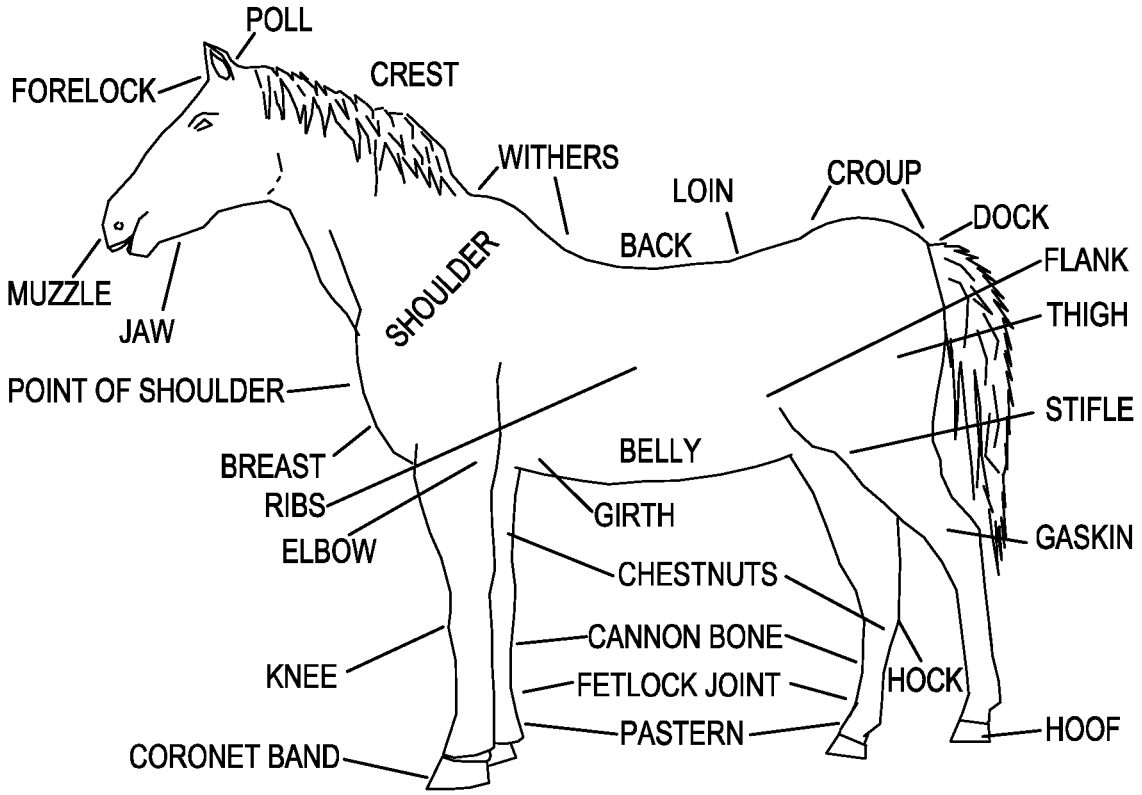
(PRIOR ART) FIG. 1A
FIG. 1A is an image that illustrates an example of different regions of a body of a horse.
Figure 1B:
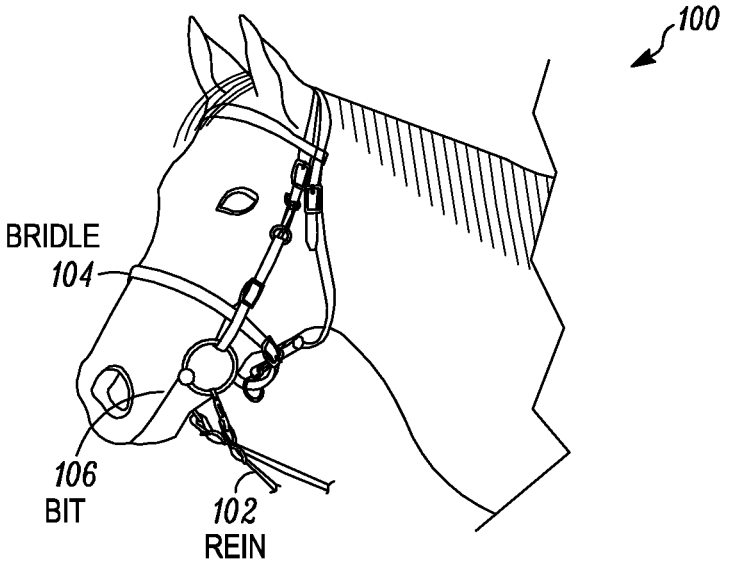
(PRIOR ART) FIG. 1B
FIG. 1B is an image that illustrates an example of a conventional system to facilitate communication between a horse and a rider.

A method and apparatus and system are described for facilitating communication between a horse and a rider. In the following description, for the purposes of explanation, numerous specific details are set forth in order to provide a thorough understanding of the present invention. It will be apparent, however, to one skilled in the art that the present invention may be practiced without these specific details. In other instances, well-known structures and devices are shown in block diagram form in order to avoid unnecessarily obscuring the present invention.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements at the time of this writing. Furthermore, unless otherwise clear from the context, a numerical value presented herein has an implied precision given by the least significant digit. Thus a value 1.1 implies a value from 1.05 to 1.15. The term "about" is used to indicate a broader range centered on the given value, and unless otherwise clear from the context implies a broader range around the least significant digit, such as "about 1.1" implies a range from 1.0 to 1.2. If the least significant digit is unclear, then the term "about" implies a factor of two, e.g., "about X" implies a value in the range from 0.5X to 2X, for example, about 100 implies a value in a range from 50 to 200. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

Some embodiments of the invention are described below in the context of horse riding. In other embodiments, the invention is described in the context of horse racing. In yet other embodiments, the invention is described in the context of horse shows and/or horse show jumping. For purpose of this description, "horse" means one of two extant subspecies of *Equus ferus*. In another embodiment, for purpose of this description, "horse" means an odd-toed ungulate mammal belonging to the taxonomic family Equidae. Horse breeds are loosely divided into three categories based on general temperament: spirited "hot bloods" with speed and endurance; "cold bloods", such as draft horses and some ponies, suitable for slow, heavy work; and "warmbloods", developed from crosses between hot bloods and cold bloods, often focusing on creating breeds for specific riding purposes, particularly in Europe. There are more than 300 breeds of horse in the world today, developed for many different uses.

Figure 2A:
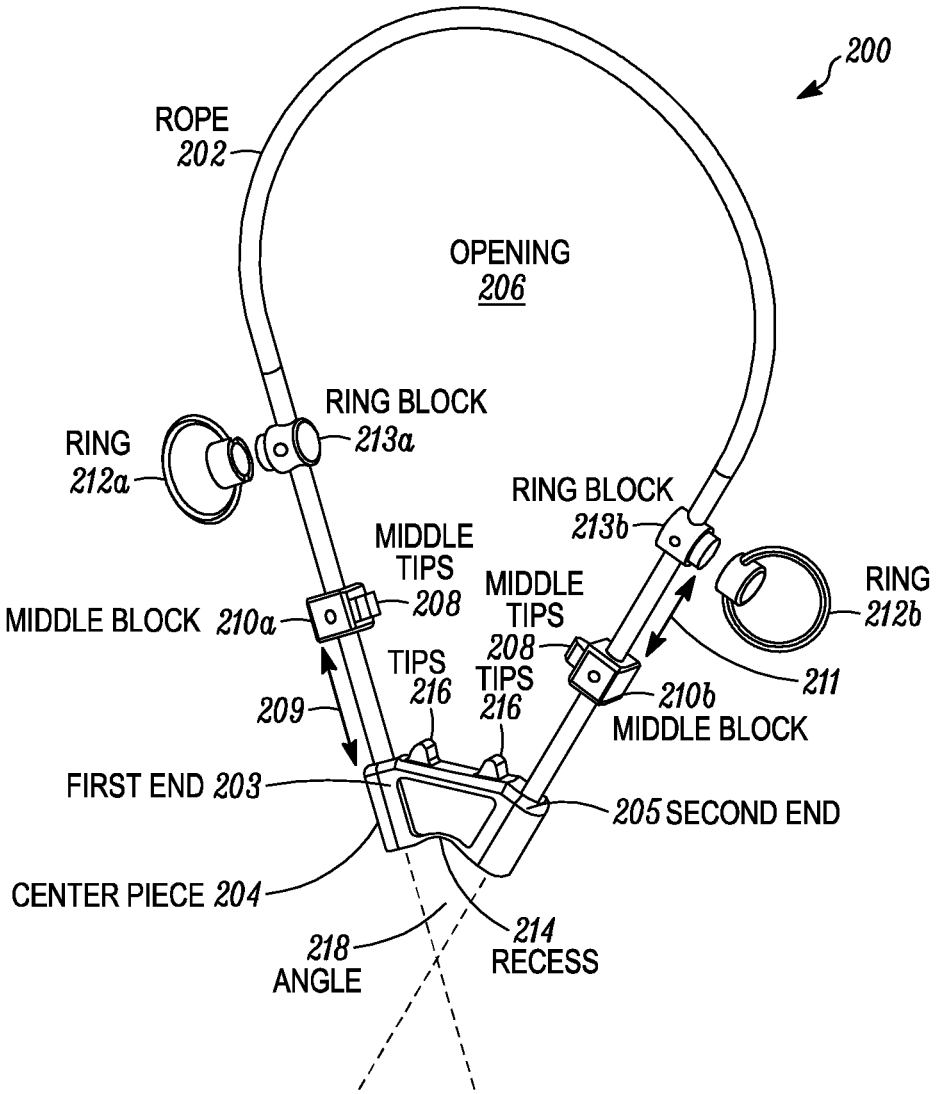
FIG. 2A is an image that illustrates an example of a plan view of an apparatus to facilitate communication between a horse and a rider, according to an embodiment.

FIG. 2A is an image that illustrates an example of a plan view of an apparatus 200 to facilitate communication between a horse and a rider, according to an embodiment. The apparatus 200 includes a line, such as a rope 202, with a first end 203 and a second end 205 opposite to the first end 203. In an example embodiment, the rope 202 has a length of about 67 inches or in a range from about 60 inches to about 75 inches. In another example embodiment, the rope 202 has a length of about 72 inches or in a range from about 65 inches to about 80 inches. In one embodiment, the rope 202 is rope made of a material that retains a shape of the rope 202 but is still sufficiently flexible of a material to adjust to the horses' movement. In one example embodiment, the rope 202 is made of stiff nylon or polyester rope and/or has a diameter about 5/16 or about 3/8 inches. In another example embodiment, the rope 202 is made from braided (or twisted) rawhide. In another embodiment the line is a wire (e.g. made from metal material such as steel).

In an embodiment, the apparatus 200 also includes a center piece 204 operatively connected to the first end 203 and the second end 205. In one embodiment, the first end 203 and the second end 205 are secured within openings 220*a*, 220*b* (FIG. 2C) defined by the center piece 204, such as with a set screw (e.g. received within set screw opening 215 on each side of the center piece 204, see FIG. 3A) and/or with an adhesive. In another embodiment, the first end 203 and the second end 205 are integral and/or welded to the center piece 204. Based on the first end 203 and the second end 205 being secured to the center piece 204, the rope 202 defines an opening 206. In some embodiments, the first end 203 is connected to the second end 205 and in this embodiment the center piece 204 is omitted. In one embodiment, the opening 206 is sized to receive a head of a horse. In one example embodiment the opening 206 is oval-shaped, such as the oval-shaped opening 606 shown in FIG. 6A. In an embodiment, a height 602 of the oval-shaped opening 606 is about 29 inches or about 31 inches or in a range from about 20 inches to about 40 inches and/or is based on a height from a crest to a breast of the horse. In another embodiment, a width 605 of the oval-shaped opening 606 is about 13 inches or in a range from about 10 inches to about 15 inches.

Although FIG. 2A depicts an embodiment where the first end 203 and the second end 205 of the rope 202 are secured within the center piece 204, in other embodiments the first end 203 and the second end 205 extend beyond the center piece 204. In this example embodiment, the rope 202 is still secured within the center piece 204 but the first end 203 and second end 205 may extend beyond the center piece 204. One example embodiment of this design is where the first end 203 and second end 205 are movable relative to the center piece 204 to adjust a size of the opening 206 (e.g. for different size horses). In this example embodiment, a mechanism is provided within the center piece 204 to selectively tighten/loosen the rope 202 within the center piece 204.

In an embodiment, the apparatus 200 also includes a pair of middle tips 208 operatively connected to the rope 202 with a pair of respective middle blocks 210*a*, 210*b*. In one embodiment, the pair of middle tips 208 are spaced apart from the first end 203 and the second end 205 by a first separation 209 (e.g. about 7 inches or in a range from about 6 inches to about 8 inches). In another embodiment, the pair of middle tips 208 are oriented inward from the rope 202 toward and into the opening 206. In an example embodiment, the middle tips 208 make an angle that is about orthogonal (e.g. about 90 degrees or in a range from about 70 degrees to about 110 degrees) relative to the rope 202 where the middle blocks 210*a*, 210*b* are secured. In another embodiment, the middle tips 208 are sufficiently smooth (e.g. radius of curvature greater than a threshold curvature) so that the middle tips 208 do not injure the horse when they engage the horse. In some embodiments, the middle tips 208 are integral with the line (e.g. rope 202) and thus the middle blocks 210*a*, 210*b* can be omitted.

Figure 5A:
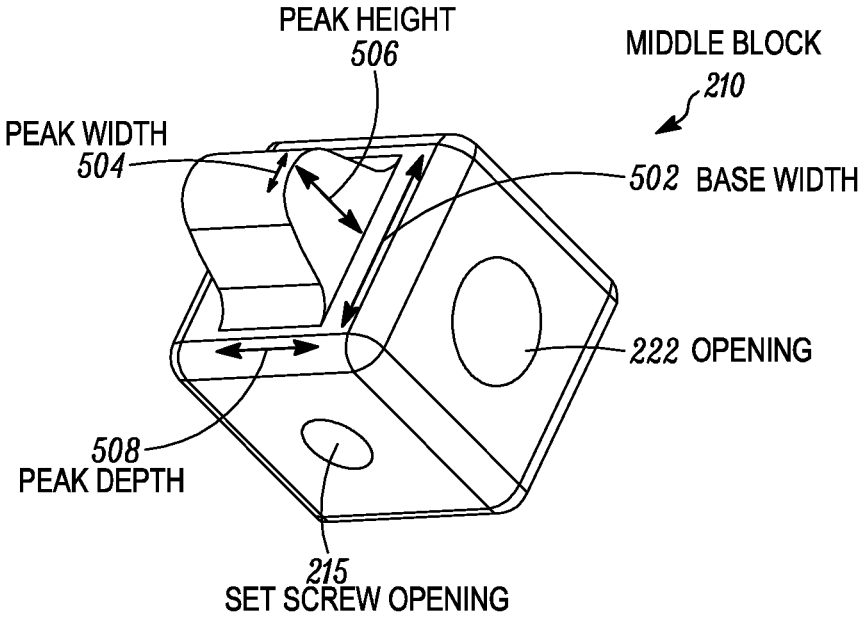
FIGS. 5A through 5B are images that illustrate an example of various views of a middle block of the apparatus of FIG. 2A, according to an embodiment.

In an embodiment, the middle tip 208 has one or more dimensions as depicted in FIG. 5A. In one embodiment, the middle tip 208 has a base width 502 of about 0.5 inches or in a range from about 0.4 inches to about 0.7 inches and a peak width 504 that is less than the base width 502 and about 0.3 inches or in a range from about 0.2 inches to about 0.4 inches. In one embodiment, the middle tip 208 has a peak height 506 of about 0.4 inches or in a range from about 0.3 inches to about 0.5 inches. In one embodiment, the middle tip 208 has a peak depth 508 of about 0.5 inches or in a range from about 0.4 inches to about 0.6 inches. In one example embodiment, the tip 516 has one or more dimensions that are similar to the dimensions of the tip 208. These listed numerical dimensional ranges are merely one example embodiment of dimensions of the middle tip 508 and the middle tip 508 is not limited to dimensions within these numerical ranges.

In an embodiment, the middle tips 208 are operatively connected to the rope 202 based on a pair of middle blocks 210*a*, 210*b*. In an embodiment, the rope 202 is secured within openings 222*a*, 222*b* (FIG. 2C) defined by the pair of middle blocks 210*a*, 210*b* (e.g. using a set screw passed through the set screw opening 215, see FIG. 5A). In some embodiments, the middle tips 208 are integral with the middle blocks 210*a*, 210*b* (e.g. each middle tip 208 is integrally formed with the respective middle block 210 such as using a one-piece mold and/or is billet machined). In other embodiments, the middle tip 208 is removable and/or replaceable from the middle block 210 which remains connected to the rope 202 (e.g. the middle tips 208 can be removed and/or replaced when they become worn and/or damaged). In an example embodiment, the middle tips 208 and/or middle block 210 is made from synthetic and/or non-synthetic material, including but not limited to aluminum and/or steel material. Although two tips 208 depicted in FIG. 2A (one on each side of the opening 206), in other embodiments, less or more than two tips 208 are provided along the rope 202.

In an embodiment, the apparatus 200 also includes a pair of rings 212*a*, 212*b* operatively connected to the rope 202 and defines second openings that are sized (e.g. diameter of about 27/64 inches or in a range from about 0.2 inches to about 1 inch and/or a diameter about equal to or greater than an outer diameter of the rope 202 to receive the rein 102). In another embodiment, the outer diameter of the rings 212*a*, 212*b* is about 2 inches or in a range from about 1 inch to about 3 inches In one embodiment, the pair of rings 212*a*, 212*b* are spaced apart from the middle tips 208 by a second separation 211. In one embodiment, the second separation 211 (e.g. about 10.5 inches or in a range from about 9 inches to about 12 inches) is greater than the first separation 209 (e.g. about 7 inches or in a range from about 6 inches to about 8 inches). As shown in FIG. 2A, the pair of rings 212*a*, 212*b* are oriented outward from the rope 202 and away from the opening 206.

In an embodiment, the pair of rings 212*a*, 212*b* are operatively connected to the rope 202 based on a pair of ring blocks 213*a*, 213*b*. In an embodiment, the rope 202 is secured within first openings 224*a*, 224*b* (FIG. 2C) defined by the pair of ring blocks 213*a*, 213*b* (e.g. using a set screw received in the set screw opening 215, see FIG. 4B). In some embodiments, the pair of rings 212*a*, 212*b* are secured within second openings 226*a*, 226*b* (FIG. 2C) defined by the pair of ring blocks 213*a*, 213*b* (e.g. using a set screw received in the set screw 215, see FIG. 4B). In one embodiment, each ring block 213*a*, 213*b* includes a pair of ring blocks where a first ring block defines the first opening 224*a* and a second ring block defines the second opening 226*a* and wherein the first and second ring block are connected (e.g. using a mating connection). In other embodiments, as shown in FIG. 4C, the ring block 213' is a one-piece or integral ring block which features a first opening 224 to receive the rope 202 and a second opening 226 to receive the ring 212'. In this embodiment, the ring 212' is a crimped ring. In an example embodiment, the crimped ring features a first tip and a second tip that are separated so that the first tip enters the first opening 224 on one side of the ring block 213' and the second tip enters the first opening 224 on an opposite side of the ring block 213' after which the first and second tips are brought together (e.g. using a pliers) to secure the crimped ring to the one-piece ring block 213'. As further shown in FIG. 4C, in this example embodiment, the one-piece ring block 213' defines the set screw opening 215 that is described above with respect to the other ring block designs.

In an embodiment, the center piece 204 includes a pair of tips 216 that are spaced apart along an inner surface of the center piece 204 that defines the opening 206. In an embodiment the pair of tips 216 are oriented inward from the center piece 204 and toward or into the opening 206. Although two tips 216 are depicted in FIG. 2A, in other embodiments, less or more than two tips 216 are provided along the inner surface of the center piece 204. In an example embodiment, each tip 216 has dimensions and/or a radius of curvature that are similar to the middle tips 208. In some embodiments, the tips 216 are integral with the center piece 204 (e.g. each tip 216 is integrally formed with the center piece 204 such that the center piece 204 and tips 216 are formed using a one-piece mold and/or is billet machined). In other embodiments, the tips 216 are removable and/or replaceable from the center piece 204. In an example embodiment, the tips 216 and/or center piece 204 are made from synthetic and/or non-synthetic material, including but not limited to aluminum and/or steel material.

In an embodiment, the center piece 204 defines a V-shaped recess 214 along a side of the center piece 204 that is opposite the inner surface of the center piece 204 with the tips 216 and/or is opposite from the opening 206. The inventors recognized that the V-shaped recess 214 advantageously removed excess material in the process of forming the center piece 204 and thus reduced the manufacturing costs of the apparatus 100.

In an embodiment, the center piece 204 is configured with the openings 220*a*, 220*b* (FIG. 2C) that are oriented so that when the first end 203 and the second end 205 are secured within the openings 220*a*, 220*b*, an angle 218 (FIG. 2A) is formed between the first end 203 and the second end 205. In an example embodiment, the angle 218 is about 50 degrees or in a range from about 40 degrees to about 60 degrees.

Figure 2B:
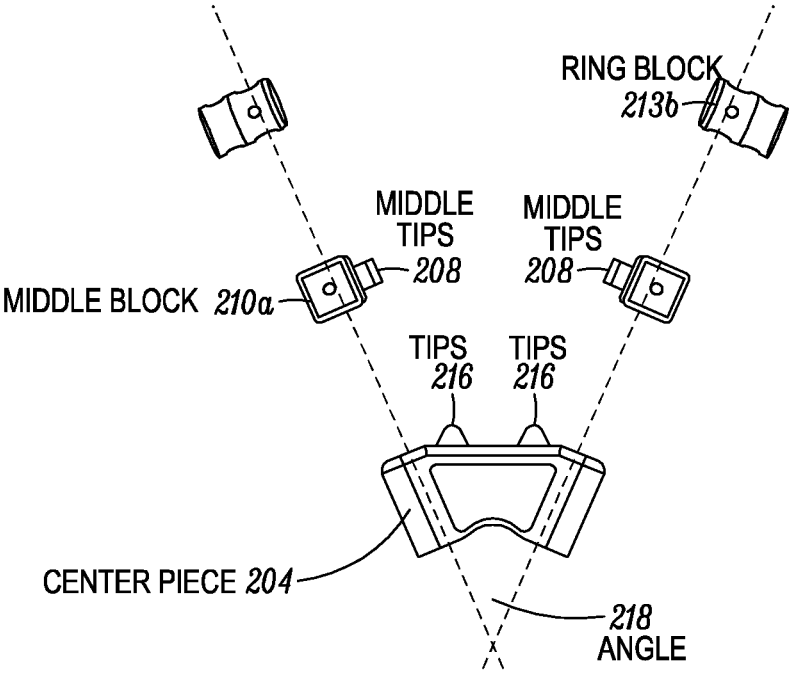
FIG. 2B is an image that illustrates an example of the plan view of the apparatus of FIG. 2A without the line, according to an embodiment.
Figure 2C:
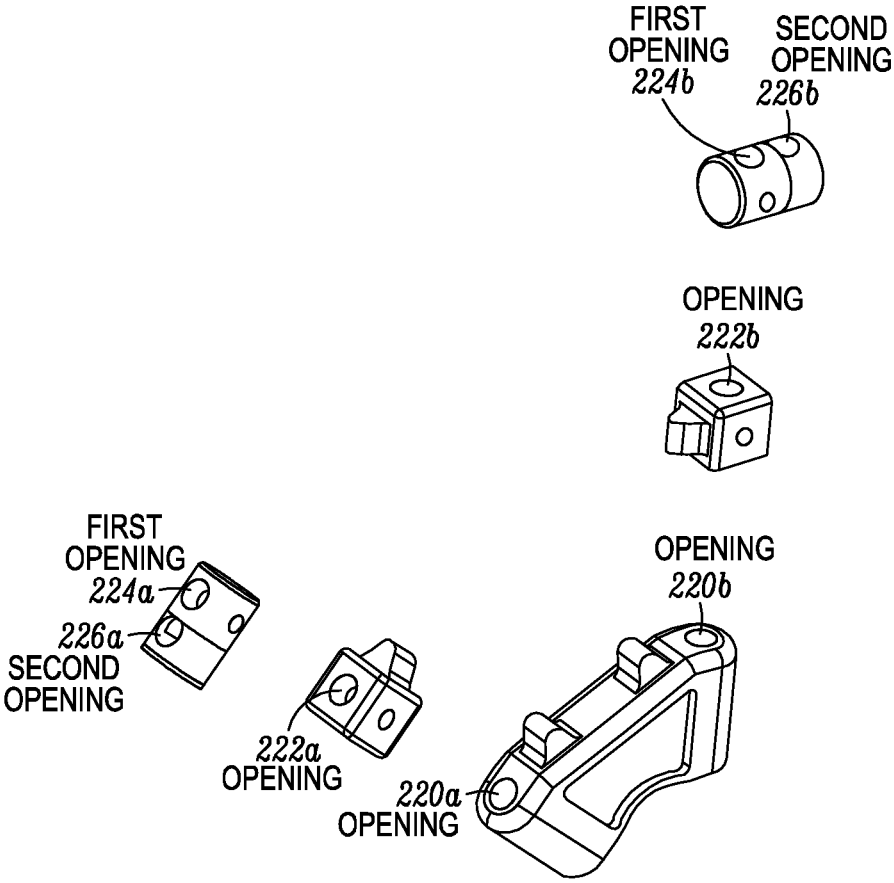
FIG. 2C is an image that illustrates an example of a perspective view of the apparatus of FIG. 2A without the line, according to an embodiment.

FIG. 2B is an image that illustrates an example of the plan view of the apparatus 200 of FIG. 2A without the line, according to an embodiment. Dotted lines in FIG. 2B are in the position of the rope 202 and further depict the angle 218 that the first and second ends 203, 205 make at the center piece 204. FIG. 2C is an image that illustrates an example of a perspective view of the apparatus 200 of FIG. 2A without the line, according to an embodiment. In an embodiment, the openings 220, 222, 224, 226 shown in FIG. 2C have an inner diameter of about 0.45 inches or in a range from about 0.3 inches to about 0.6 inches and/or the rope 202 has an outer diameter of about 27/64 inches or in a range from about 0.1 inch to about 1 inch so that the rope 202 can securely fit within the openings and/or so that a mating connection is provided between the rope 202 and the openings.

Figure 3A:
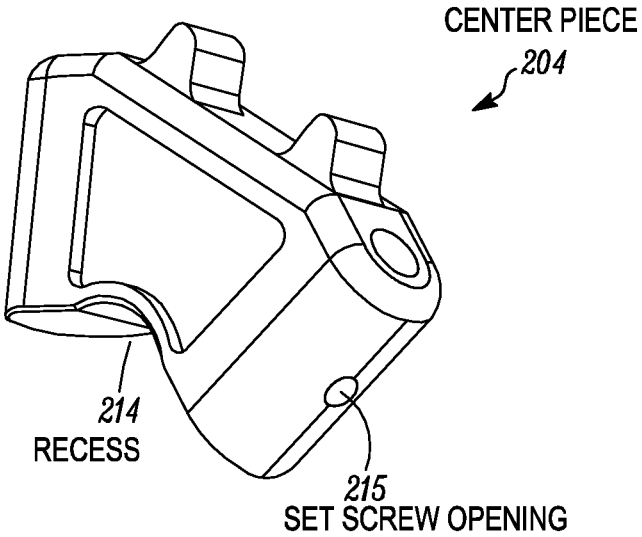
FIGS. 3A through 3C are images that illustrate an example of various views of a center piece of the apparatus of FIG. 2A, according to an embodiment.
Figure 3B:
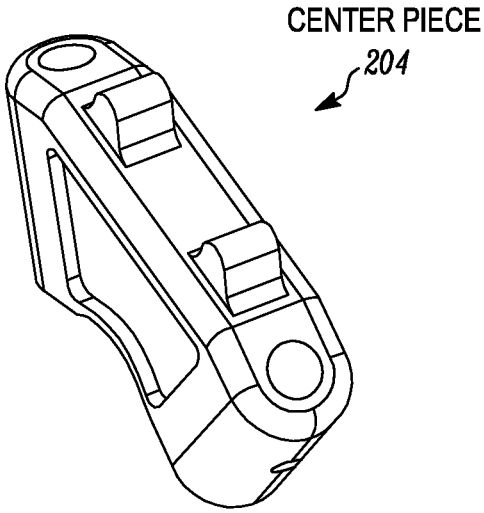
Figure 3C:
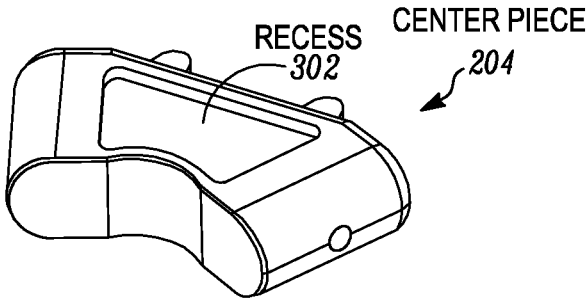

FIGS. 3A through 3C are images that illustrate an example of various views of the center piece 204 of the apparatus 200 of FIG. 2A, according to an embodiment. In an embodiment, FIGS. 3A through 3C depict the V-shaped recess 214 on the side of the center piece 204 opposite to the tips 216 along the inner surface and an additional recess 302 provided along one or more sides of the center piece 204.

The inventors realized that the recesses 214, 302 advantageously reduce the amount of material used during the forming of the center piece 204 and thus improve the cost efficiency of manufacturing the apparatus 100. Additionally, in another embodiment the inventors realized that the recesses 214, 302 advantageously result in the center piece 204 having a weight that is more appropriate (e.g. where the recesses 214, 302 advantageously reduce the weight of the piece 204 so not affect the use of the apparatus).

Figure 4A:
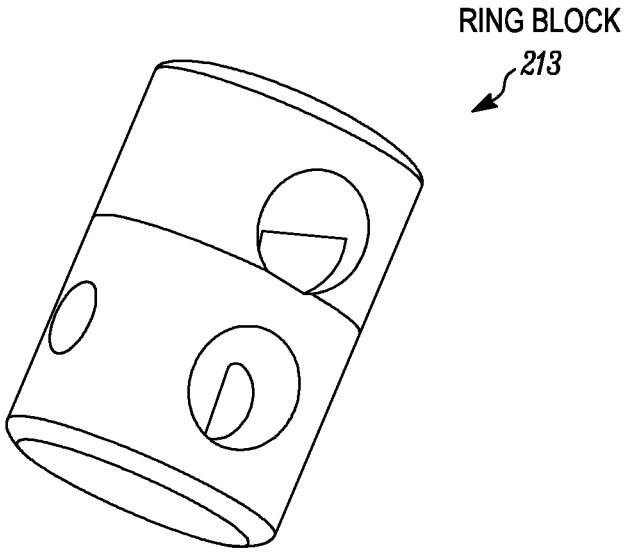
FIGS. 4A through 4C are images that illustrate an example of various views of a ring block of the apparatus of FIG. 2A, according to an embodiment.
Figure 4B:
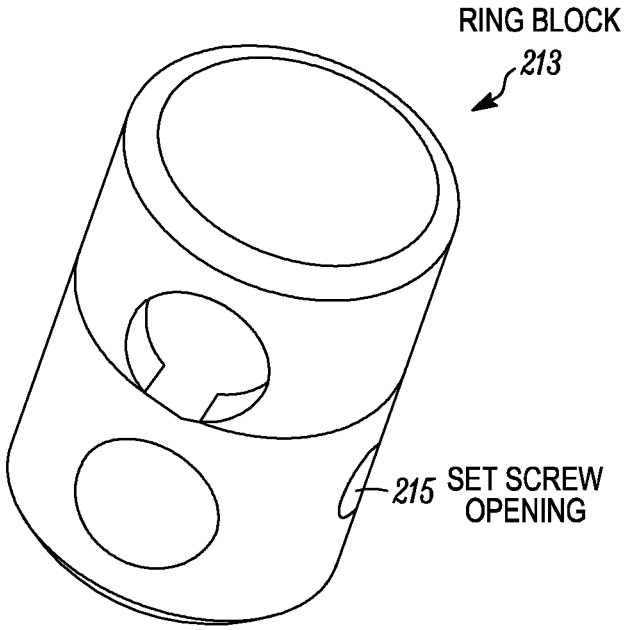
Figure 4C:
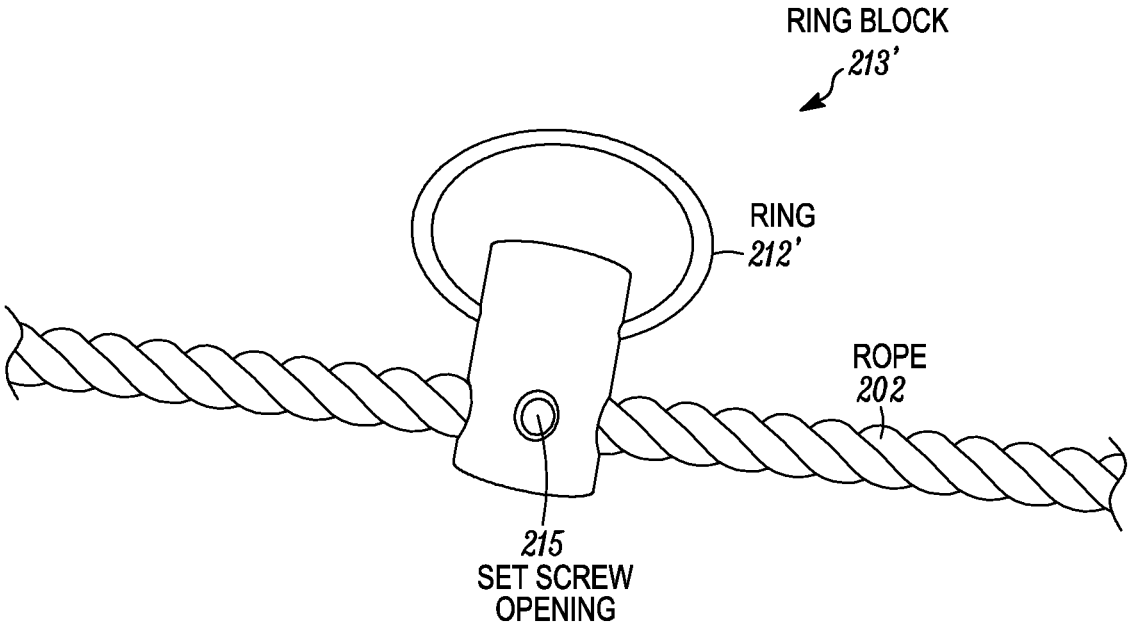
Figure 5B:
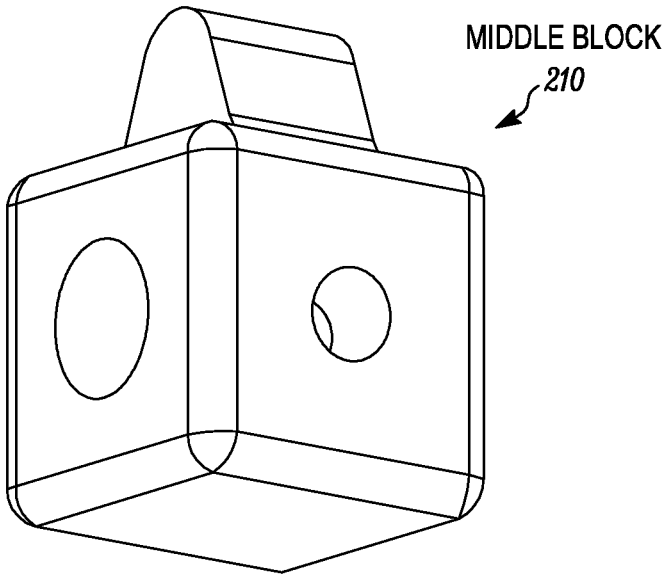

FIGS. 4A through 4C are images that illustrate an example of various views of the ring block 213, 213' of the apparatus 200 of FIG. 2A, according to an embodiment. FIGS. 5A-5B are images that illustrate an example of various views of the middle block 210 of the apparatus 200 of FIG. 2A, according to an embodiment. In one embodiment, the middle tip 208 defines one or more dimensions including a base width 502 and a peak width 504 that is less than the base width 502. In another embodiment, the middle tip 502 defines a peak height 506 (e.g. that extends in a direction from the rope 202 into the opening 206) and a peak depth 508 (e.g. that extends along the rope 202 when the middle block 510 is connected to the rope 202). In one example embodiment, the peak width 504 is sufficiently large that the middle tip 208 does not injure the horse when it engages the horse and/or merely taps the surface of the body of the horse without causing the horse any pain. In still other embodiments, the middle tip 208 may have a tapered transition around 360 degrees of the tip 208 (e.g. along the plane aligned with the rope 202 and the plane orthogonal with the rope 202 inserted through the opening 202).

Figure 6A:
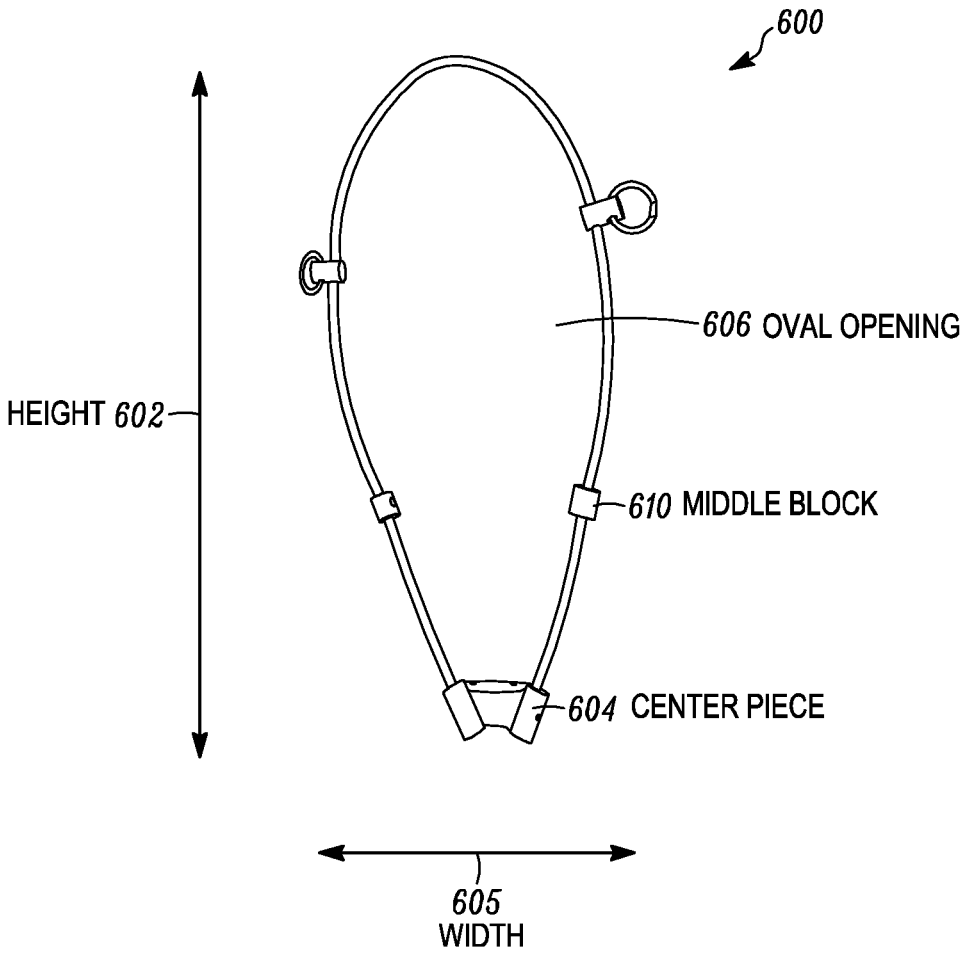
FIG. 6A is an image that illustrates an example of a plan view of an apparatus to facilitate communication between a horse and a rider, according to an embodiment.
Figure 6B:
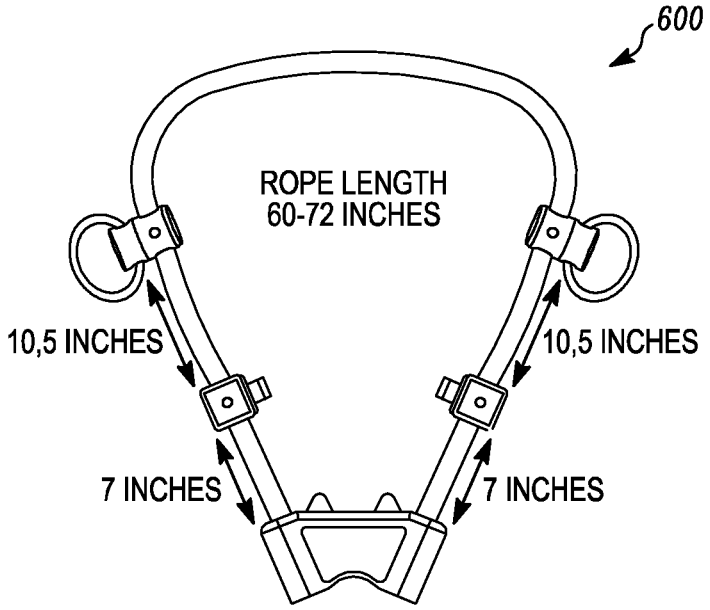
FIG. 6B is a schematic drawing that illustrates an example of the plan view of the apparatus of FIG. 6A, according to an embodiment.
Figure 6C:
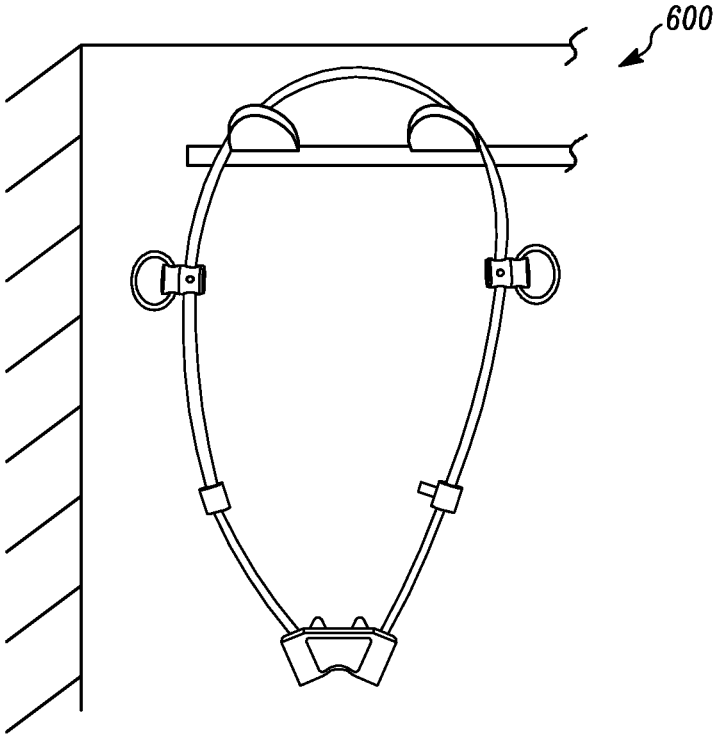
FIG. 6C is an image that illustrates an example of the plan view of the apparatus of FIG. 6A, according to an embodiment.

FIG. 6A is an image that illustrates an example of a plan view of an apparatus 600 to facilitate communication between a horse and a rider, according to an embodiment. The apparatus 600 is similar to the apparatus 200 of FIG. 2A, except the center piece 604 was welded together from multiple components and/or the middle block 610 is configured to receive removable or replaceable middle tips, among other characteristics. FIG. 6B is a schematic drawing that illustrates an example of the plan view of the apparatus 600 of FIG. 6A, according to an embodiment. The numerical dimensions depicted in FIG. 6B are merely one example of numerical dimension of the apparatus 600 and does not limit the dimensions of the apparatus 600 which can be sized with dimensions outside these example dimensions. FIG. 6C is an image that illustrates an example of the plan view of the apparatus 600 of FIG. 6A, according to an embodiment.

Figure 7A:
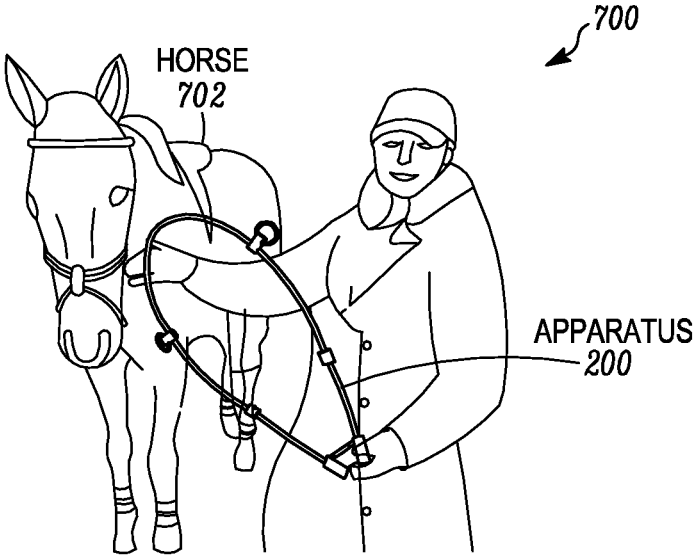
FIGS. 7A through 7L are images that illustrate an example of various views of one or more steps of a method for facilitating communication between a horse and a ride, according to an embodiment.
Figure 7B:
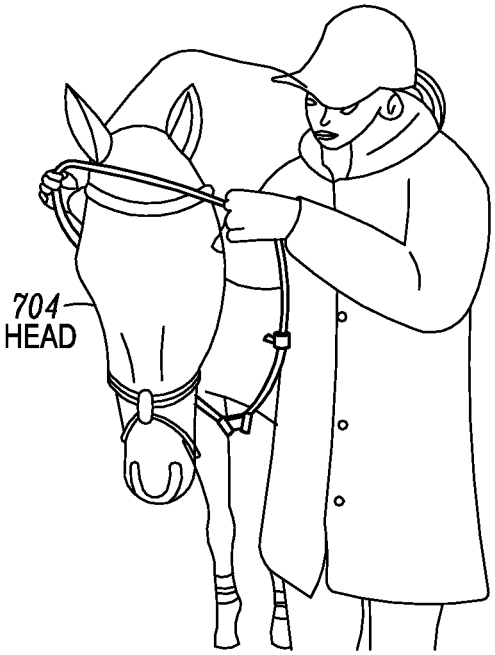

FIGS. 7A through 7L are images that illustrate an example of various views of one or more steps of a method for facilitating communication between a horse and a rider, according to an embodiment. FIG. 7A depicts an embodiment of a rider holding the apparatus 200 of FIG. 2A and a horse 702. The horse 702 and the rider are not part of the apparatus 200. FIG. 7B depicts an embodiment of a rider moving the apparatus 200 so that the head 704 of the horse 702 passes through the opening 206 defined by the rope 202.

Figure 7C:
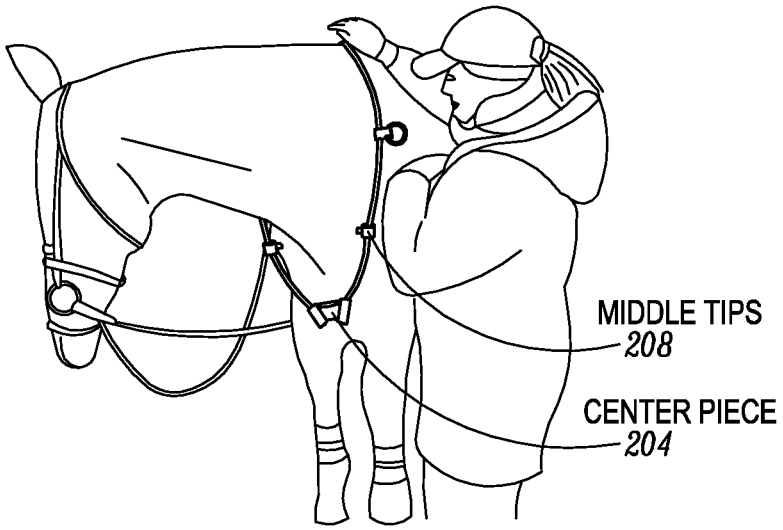

FIG. 7C depicts an embodiment showing the apparatus 200 on the horse 702 after passing the head 704 of the horse 702 through the opening 206. In this embodiment, the middle tips 208 are positioned adjacent the left and right points of shoulder and/or the left and right shoulder (FIG. 1A) of the horse 702. Also in this embodiment, the center piece 204 is positioned adjacent the breast of the horse 702 (FIG. 1A).

Figure 7D:
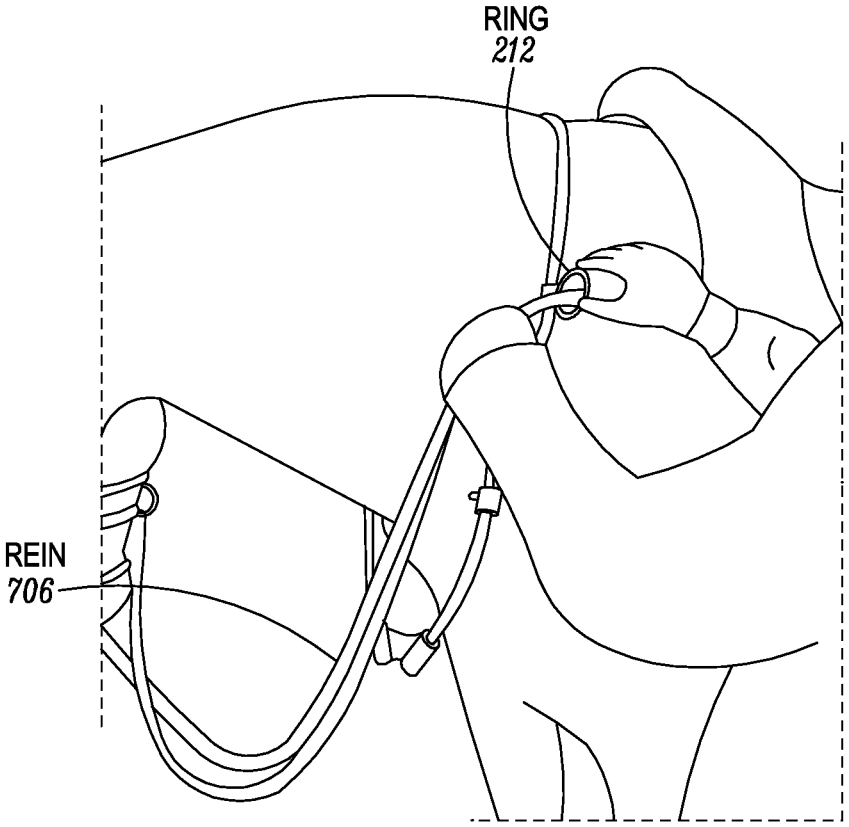
Figure 7E:
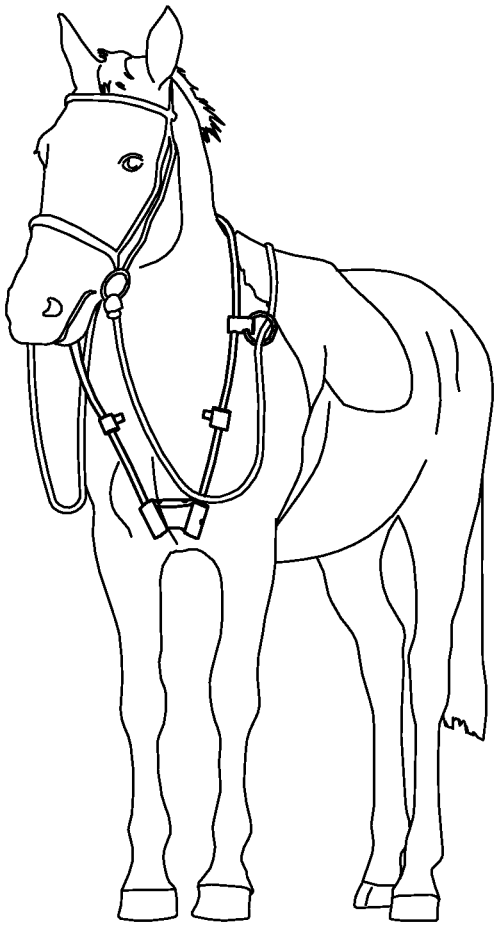
Figure 7F:
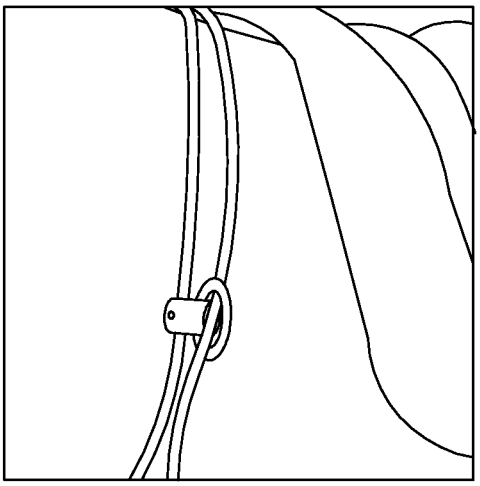

FIG. 7D depicts an embodiment showing the rider passing the rein 706 through the second opening of the ring 212. In an embodiment, the rider detaches the rein 706 into a left and right rein and passes the left rein through the left ring 212*b* and the right rein through the right ring 212*a*, after which the rider reattaches the left and right rein. FIGS. 7E and 7F depict the result of this step, where the left and right reins 706 are respectively passed through the left and right rings 212*a*, 212*b* of the apparatus 200 and the left and right reins 706 are secured together in the riding position. In some embodiments, the apparatus 200 excludes the rings 212 and thus this step is omitted (e.g. the reins 706 don't pass through rings 212).

Figure 7G:
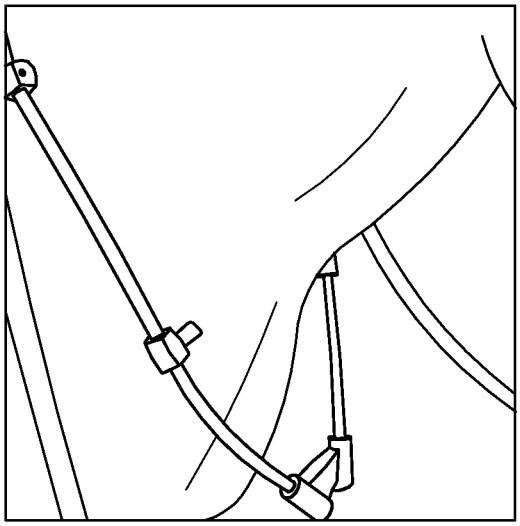
Figure 7H:
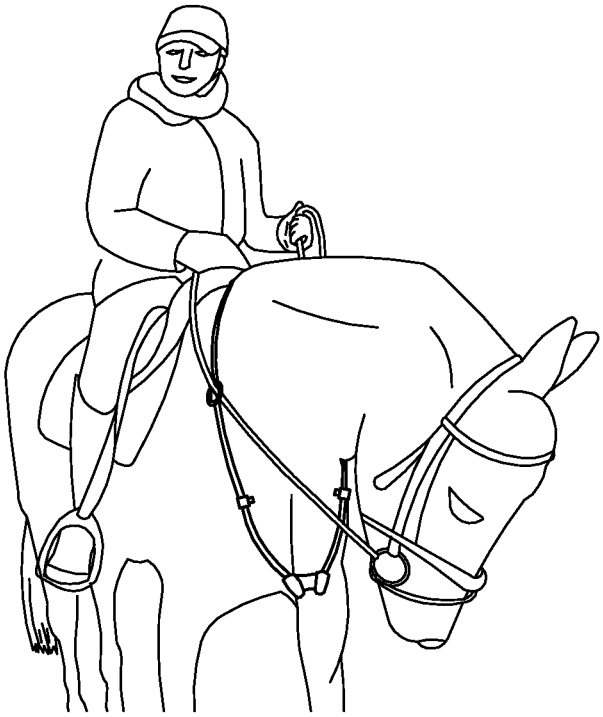

FIG. 7G depicts an embodiment showing apparatus 200 positioned around the horse 702 including the middle tips 208 adjacent the left and right point of shoulder of the horse 702 and the center piece 204 adjacent the breast of the horse. FIG. 7H depicts the rider on the horse 702 and the apparatus 200 in position on the horse 702. In an embodiment, FIG. 7H depicts that the rider is holding the reins 706 and is not holding the rope 202. The inventors noted that one advantage of the apparatus 200 is the rider need not continuously hold the rope 202. In an example embodiment, the rider need only hold the rope 202 to engage the horse (e.g. with a light tap) at the appropriate region (e.g. breast if the rider wants the horse to back up and/or slow down, left point of shoulder if the rider wants the horse to move/turn left, right point of shoulder if the rider wants the horse to move/turn right, etc.) based on the desired movement that the rider wants to horse to move and the horse swiftly responds (e.g. quicker than using the system 100 of only the rein 102, bridle 104 and bit 106).

Figure 7I:
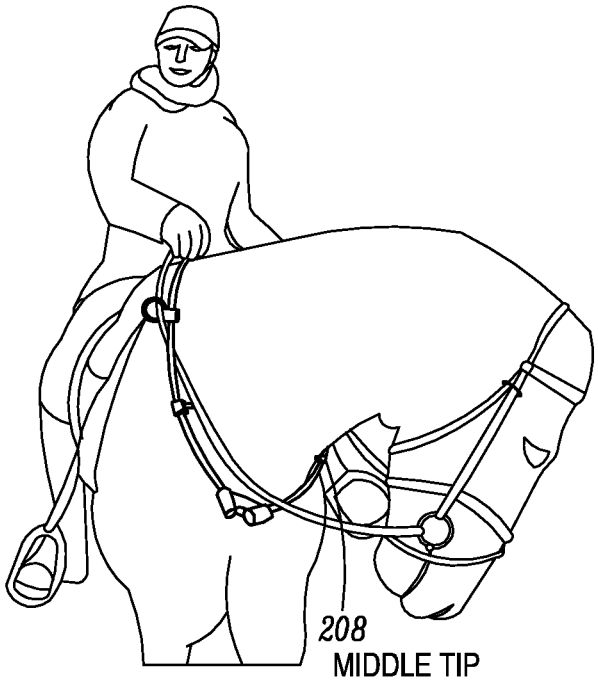
Figure 7J:
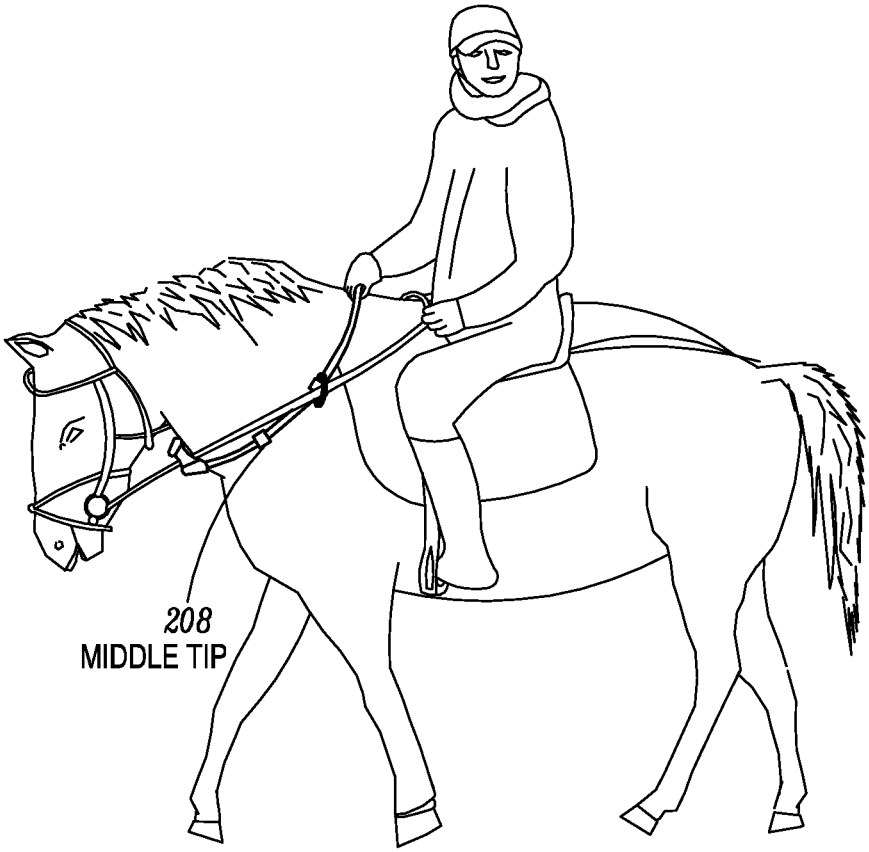

FIGS. 7I and 7J depict an embodiment showing the rider moving the rope 202 so to engage the horse 702 and cause the horse 702 to move/turn left. In an embodiment, the rider holds the rope 202 and moves the rope 202 so that the middle tip 208 engages (e.g. with a light tap) a left point of shoulder and/or left shoulder of the horse 702 which causes the horse 702 to swiftly respond and turn left (e.g. quicker than using the conventional system 100). In one example embodiment, the rider need only engage the horse 702 with the middle tip 208 with a light tap for a duration that is necessary until a correct reaction from the horse is achieved (e.g. that lasts less than a second) for the horse 702 to respond. As appreciated by one of ordinary skill in the art, different horses may require a light tap of different durations to achieve the correct reaction, based on the particular sensitivity of each respective horse. One advantage of the apparatus 200 is that by passing the rein 706 through the rings 212, the rein 706 and the rope 202 can be easily held simultaneously (see FIG. 7I where the rider is holding the rein 706 and the rope 202 in one hand). Another advantage of the apparatus 200 is that since the horse 702 responds so quickly to the light tap with the middle tip 208, the rider need only move/engage the rope 202 for a very short time in order to cause the horse 702 to move in the desired direction. Yet another advantage is that when the rider is not holding the rope 202, the middle tip 208 and tips 216 of the center piece 204 do not engage the horse (e.g. they hang below the breast/shoulder of the horse and thus do not engage the horse).

The inventors also noticed that the apparatus 200 overcomes a drawback of the conventional system 100 of only using a rein 102, bridle 104 and bit 106 where pulling the head 702 of the horse in one direction can sometimes cause the horse 702 to move in the opposite direction that the rider intends (since the horses body can swing in the opposite direction that their head is pulled). The apparatus 200 overcomes this drawback since enhanced communication is achieved by the rider directly communicating with the body of the horse 702 (e.g. left/right shoulder, left/right points of shoulder, etc.). It should be noted that the same principles discussed in regard to FIGS. 7I through 7J can be applied to using the apparatus 200 to engage the horse 702 to cause the horse 702 to turn/move right.

Figure 7K:
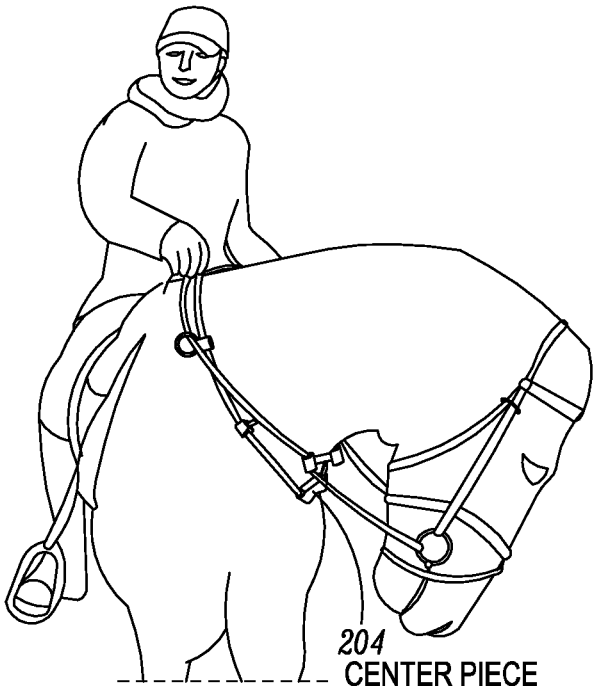
Figure 7L:
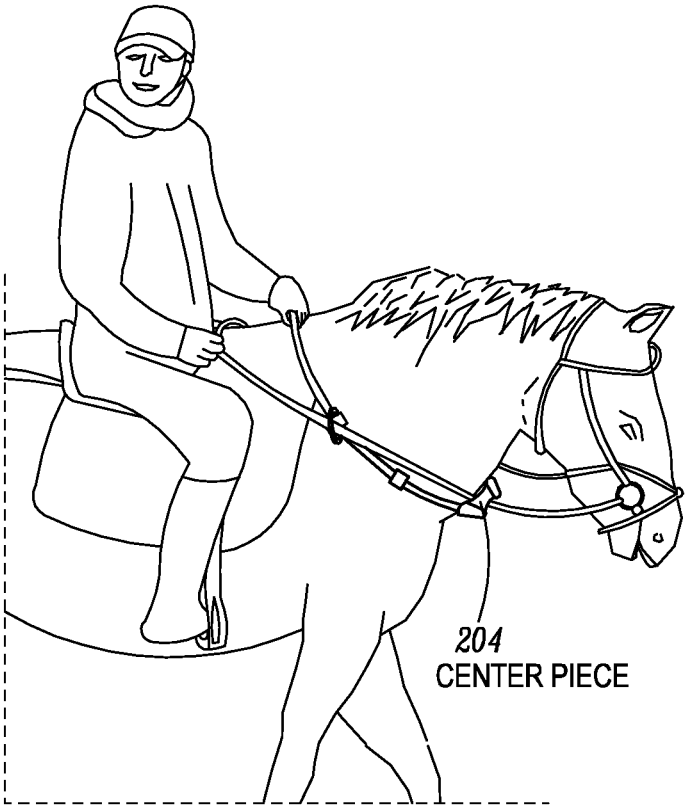

FIGS. 7K and 7L depict an embodiment showing the rider moving the rope 202 so to engage the horse 702 to cause the horse 702 to move backwards and/or brake. In an embodiment, the rider holds the rope 202 and moves the rope 202 so that the center piece 204 (e.g. tips 216) engages (e.g. with a light tap) the breast of the horse 702 which causes the horse 702 to swiftly respond and move back (e.g. quicker than using the conventional system 100). In one example embodiment, the rider need only engage the horse 702 with the tips 216 with a light tap (e.g. that lasts less than a second) for the horse 702 to respond. One advantage of the apparatus 200 is that by passing the rein 706 through the rings 212, the rein 706 and the rope 202 can be easily held simultaneously (see FIG. 7K where the rider is holding the rein 706 and the rope 202 in one hand). The inventors also noticed that the apparatus 200 overcomes a drawback of the conventional system 100 of only using a rein 102, bridle 104 and bit 106 where pulling the head 702 of the horse with both left and right reins, in an attempt to cause the horse 702 to move backwards and/or brake typically results in the horse 702 dragging their feet backwards. With the apparatus 200, engaging the breast of the horse 702 with the tips 216 of the center piece 204 makes the horse 702 understand much quicker that they need to move backwards and/or brake. Specifically, this engagement helps to lift the shoulder of the horse 702 up and gets their hind end to stay underneath them, so they can much more easily brake and/or move backwards.

Figure 8:
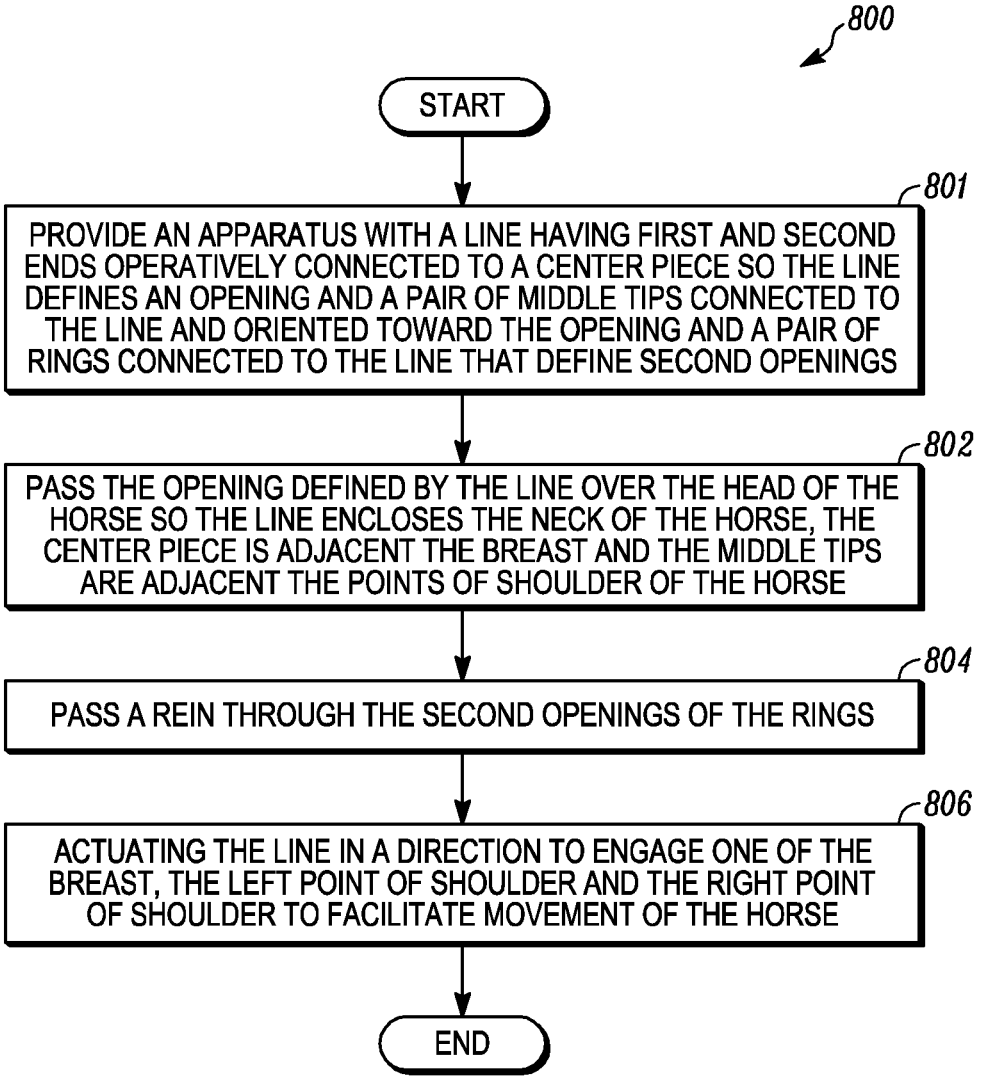
FIG. 8 is a flow chart that illustrates an example of a method for facilitating communication between a horse and a rider, according to an embodiment.

As depicted in FIG. 8, a flowchart is depicted that provides a method 800 for facilitating communication between a horse and a rider. Although the flowchart of FIG. 8 depicts particular steps in a particular order, in some embodiments the steps may be arranged in a different order and/or one or more steps may be omitted and/or additional steps may be included.

In an embodiment, in step 801 the apparatus 200 is provided. In step 802 the opening 206 defined by the rope 202 is passed over the head 704 of the horse 702 (FIG. 7B). Also, in step 802 the rope 202 encloses the neck of the horse 702 and apparatus 200 is positioned on the horse 702 so that the middle tips 208 are positioned adjacent to the left/right points of shoulder of the horse and/or the center piece 204 is positioned adjacent to the breast of the horse 702 (FIGS. 7C and 7D).

In an embodiment, in step 804 the rein 706 is passed through the second openings of the rings 212*a*, 212*b* (FIG. 7D). In one embodiment, in step 804, the left and right reins 706 are detached, the left and right reins 706 are respectively passed through the left and right rings 212*a*, 212*b* before the left and right reins 706 are reattached in the riding position (FIGS. 7E and 7F). In some embodiments, the apparatus 200 excludes the rings 212 and thus step 804 is omitted.

In an embodiment, in step 806 the rope 202 is moved in a direction so that the apparatus 200 engages a region of a body of the horse 702 to facilitate movement of the horse 702 in a desired direction. In one embodiment, step 806 involves moving the rope 202 in a left direction so that the left middle tip 208 engages a left shoulder and/or left point shoulder of the horse 702 (FIGS. 7I and 7J) to cause the horse 702 to change/turn direction to the left. In another embodiment, step 806 involves moving the rope 202 in a right direction so that the right middle tip 208 engages a right shoulder and/or right point shoulder of the horse 702 (FIGS. 7I and 7J) to cause the horse 702 to change/turn direction to the right. In another embodiment, step 806 involves moving the rope 202 in a back direction so that the tips 216 of the center piece 204 engage a breast of the horse 702 (FIGS. 7K and 7L) to cause the horse 702 to move backwards and/or brake.

In the foregoing specification, the invention has been described with reference to specific embodiments thereof. It will, however, be evident that various modifications and changes may be made thereto without departing from the broader spirit and scope of the invention. The specification and drawings are, accordingly, to be regarded in an illustrative rather than a restrictive sense. Throughout this specification and the claims, unless the context requires otherwise, the word "comprise" and its variations, such as "comprises" and "comprising," will be understood to imply the inclusion of a stated item, element or step or group of items, elements or steps but not the exclusion of any other item, element or step or group of items, elements or steps. Furthermore, the indefinite article "a" or "an" is meant to indicate one or more of the items, elements or steps modified by the article. As used herein, unless otherwise clear from the context, a value is "about" another value if it is within a factor of two (twice or half) of the other value. While example ranges are given, unless otherwise clear from the context, any contained ranges are also intended in various embodiments. Thus, a range from 0 to 10 includes the range 1 to 4 in some embodiments.

What is claimed is:

1. An apparatus to facilitate riding a horse with a rein, comprising:

a line that defines an opening sized to receive a head of the horse;

one or more tips operatively connected to the line and oriented inward from the line into the opening such that upon positioning the head of the horse through the opening the one or more tips are positioned to engage a body of the horse;

a center piece operatively connected to the first end and the second end of the line so that the line defines the opening; and wherein the one or more tips comprise;

a pair of middle tips operatively connected to the line and spaced apart from the first end and the second end by a first separation, wherein the middle tips are oriented inward from the line into the opening, and a pair of tips along an inner surface of the center piece that further define the opening and wherein the pair of tips are oriented inward from the center piece into the opening.

2. The apparatus of claim 1, further comprising a pair of rings operatively connected to the line, wherein the pair of rings define respective openings sized to receive the rein.

3. The apparatus of claim 2, wherein the pair of rings are spaced apart from the pair of middle tips by a second separation that is greater than the first separation.

4. The apparatus of claim 3, wherein the first separation is in a range from about 6 inches to about 8 inches and wherein the second separation is in a range from about 9 inches to about 12 inches.

5. The apparatus of claim 1, wherein the line is one of a rope and a wire.

6. The apparatus of claim 5, wherein the line is a rope made from at least one of stiff nylon or polyester material.

7. The apparatus of claim 1, wherein the center piece defines a V-shaped recess along a side of the center piece that is opposite to the inner surface.

8. The apparatus of claim 1, wherein the first end and the second end are operatively connected to the center piece such that an angle is formed between the first end and the second end at the center piece, wherein the angle is in a range from about 40 degrees to about 60 degrees.

9. The apparatus of claim 1, wherein the line is configured so that the line defines the opening having an oval shape wherein a height of the oval shape is based on a height from a crest to a breast of the horse and wherein a width of the oval shape is based on a width between left and right shoulders of the horse.

10. The apparatus of claim 1, wherein a length of the line is in a range from about 60 inches to about 80 inches.

11. The apparatus of claim 2, wherein the pair of rings are oriented outward from the line and on an opposite side of the line from the opening.

12. An apparatus to facilitate riding a horse with a rein, comprising:

a line that defines an opening sized to receive a head of the horse;

a pair of middle tips operatively connected to the line and oriented inward from the line into the opening such that upon positioning the head of the horse through the opening the pair of middle tips are positioned to engage a body of the horse;

a center piece operatively connected to the first end and the second end of the line so that the line defines the opening; and wherein the pair of middle tips are spaced apart from the first end and the second end by a first separation, wherein the middle tips are oriented inward from the line into the opening; and wherein the middle tips are operatively connected to the line based on a pair of middle blocks integral with the pair of middle tips, wherein the line is secured within a pair of openings defined by the pair of middle blocks.

13. The apparatus of claim 1, wherein the first end and the second end of the line are operatively connected to the center piece based on the first and second ends secured within a pair of openings defined by the center piece.

14. An apparatus to facilitate riding a horse with a rein, comprising:

a line that defines an opening sized to receive a head of the horse;

one or more tips operatively connected to the line and oriented inward from the line into the opening such that upon positioning the head of the horse through the opening the one or more tips are positioned to engage a body of the horse; and a pair of rings operatively connected to the line, wherein the pair of rings define respective openings sized to receive the rein;

wherein the pair of rings are operatively connected to the line based on a pair of ring blocks, wherein the line is secured within a pair of first openings defined by the pair of ring blocks and wherein the pair of rings are secured within a pair of second openings defined by the pair of ring blocks.

15. The apparatus of claim 1, wherein the one or more tips are operatively connected to the line and oriented inward such that upon positioning the head of the horse through the opening the one or more tips are positioned to engage one of a shoulder and a breast of the horse.

16. A method for facilitating riding a horse with a rein, comprising:

providing the apparatus of claim 2;

passing, the opening defined by the line, over a head of the horse so that the line encloses a neck of the horse, the center piece is adjacent a breast of the horse and the pair of middle tips are adjacent left and right points of shoulder of the horse;

passing, the rein, through the openings defined by the pair of rings; and actuating the line to engage one of the breast, left point of shoulder and right point of shoulder of the horse to facilitate movement of the horse.

17. The method of claim 16, wherein the actuating comprises moving the line in a back direction to engage the breast of the horse with the center piece to facilitate backward movement of the horse.

18. The method of claim 16, wherein the actuating comprises moving the line in one of a left direction or right direction to engage the left point of shoulder or right point of shoulder of the horse to respectively facilitate left movement or right movement of the horse.

* * * * *